United States Patent [19]

La Mura

[11] 4,063,829

[45] Dec. 20, 1977

[54] FOUNTAIN BRUSH

[76] Inventor: Joseph L. La Mura, 367 Passiac Ave., West Caldwell, N.J. 07039

[21] Appl. No.: 680,106

[22] Filed: Apr. 26, 1976

[51] Int. Cl.[2] ..... B43K 5/16; B43K 7/12

[52] U.S. Cl. ..... 401/101; 401/115; 401/274

[58] Field of Search ..... 401/101, 274, 115, 151, 401/259, 205, 176

[56] References Cited

U.S. PATENT DOCUMENTS

| | | | |
|---|---|---|---|
| 1,184,662 | 5/1916 | Semple | 401/274 X |
| 2,908,926 | 10/1959 | Jockers | 401/115 |
| 3,144,676 | 8/1964 | La Mura | 401/101 |
| 3,159,863 | 12/1964 | La Mura | 401/101 |
| 3,877,822 | 4/1975 | La Mura | 401/101 |

*Primary Examiner*—Stephen C. Pellegrino
*Attorney, Agent, or Firm*—Howard C. Miskin

[57] ABSTRACT

A liquid container having a captive brush in one end. A cylindrical cap seals the container and brush when not in use. To paint a small object, the cap is removed, the container is inverted, and the brush emerges from the container ready for use. A ball valve in the container adds liquid to the brush by inverting the container.

7 Claims, 5 Drawing Figures

FOUNTAIN BRUSH

CROSS REFERENCES TO RELATED PATENTS

Similar fountain brushes have been described and claimed in U.S. Pat. Nos. 3,144,676, issued Aug. 18, 1964; 3,159,863, issued Dec. 8, 1964; and 3,877,822, issued Apr. 15, 1975.

BACKGROUND OF THE INVENTION

Fountain brushes, which include a brush permanently attached to a liquid reservoir, have always had the problem of supplying just enough liquid to the brush without dripping or producing an overflow. The present invention solves this problem by providing a secondary reservoir adjoining the brush support and a ball valve adjoining the secondary reservoir for admitting liquid from the main reservoir. The ball valve is opened only when the container is turned to its upright position.

One of the features of the invention is the pumping action provided by the cylindrical brush support which is formed with two parallel splines which aid in the transfer of liquid from the secondary reservoir to the brush.

Another feature of the invention is in the additional pumping action provided by the ball in the ball valve. When the container is turned to the upright position, the ball moves through a cylindrical channel, drawing liquid through two holes in the channel walls.

SUMMARY

The fountain brush comprises a cylindrical container defining a main reservoir for the storage of liquids, a piston chamber secured to the upper end of the container, and a movable brush support enclosed therein. The piston changer is formed with an opening at its upper or brush end which permits the passage of a brush connected to the upper or brush end of the brush support. A first annular constriction in the piston chamber retains the brush support in the chamber and forms a first valve which is opened as soon as the brush is depressed from its operating position. A second valve, intermediate the ends of the piston chamber, cuts off the flow of the liquid from the main reservoir to the piston chamber when the container is inverted. The second valve includes a second annular constriction of the piston chamber and a spherical ball which control the admission of liquid to the piston chamber and brush. The second valve is opened only when the container is in its upright or non-operative position.

DESCRIPTION OF THE PREFERRED EMBODIMENT

Figure 2:
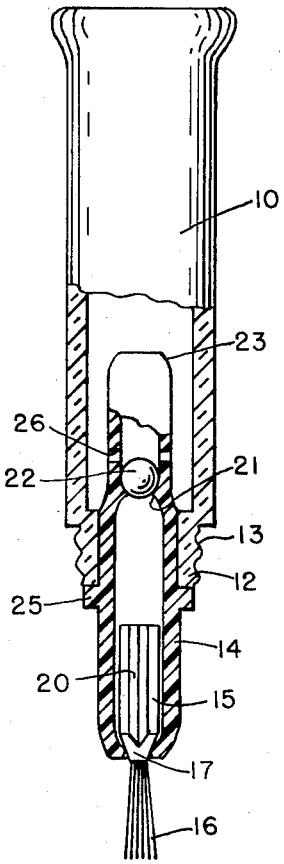
FIG. 2 is a side view, similar to FIG. 1, but with the cap removed, the container inverted, and the brush extended for spreading the liquid.
Figure 3:
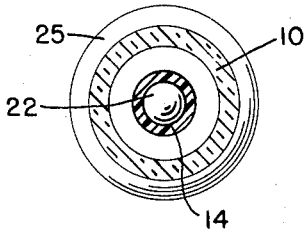
FIG. 3 is cross sectional view of the device shown in FIG. 1 and is taken along line 3—3 of that figure.
Figure 4:
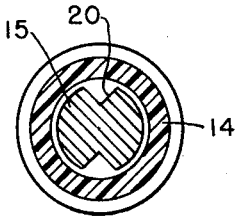
FIG. 4 is a cross sectional view of the piston chamber shown in FIG. 5 and is taken along line 4—4 of that figure.
Figure 5:
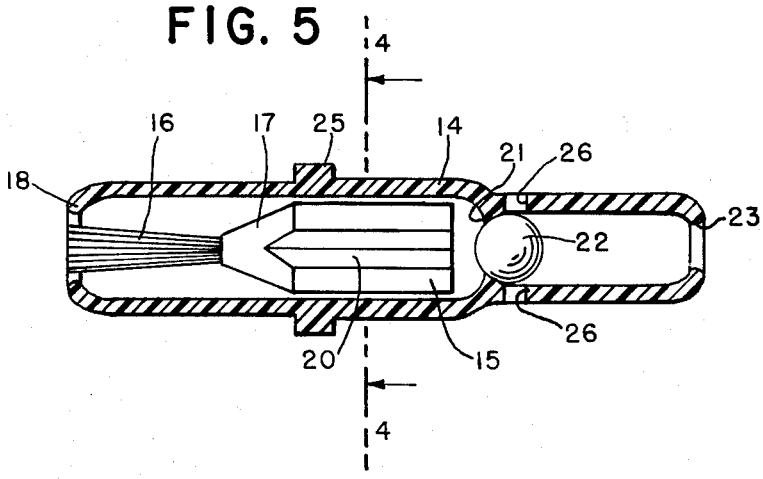
FIG. 5 is a cross sectional view of the piston chamber, to a larger scale, taken along a median line, showing the brush retracted and the ball valve closed.

Referring now to the figures, a cylindrical container 10 made of glass or plastic, acts as a reservoir for a liquid 11 to be brushed onto small objects, such as finger nails. The liquid 11 may be laquer, paint, or medicated liquid mixtures for applying to infected portions of the anatomy. The top of the container 10 is formed with a neck 12 having helical threads 13 on its outer surface. A plastic piston chamber 14 is positioned in the neck 12 and contains a movable brush support 15. The piston chamber 14 is made of a deformable plastic, such as polyethylene, so that the brush support 15 can easily be forced into its hollow portion when the device is first assembled. The brush support holds a brush 16 at one end and the ajoining surface 17 is formed in the shape of a cone so that it cooperates with a constricted portion 18 of the chamber 14 at the upper or brush end of chamber 14 to form a liquid seal when the brush support 15 is fully extended, as shown in FIG. 2. The remaining portion of the support 15 is appreciably less than the inside diameter of the piston chamber to insure that there will be no binding action as the support is extended and that the cone surface 17 forms an effective seal. Splines 20 are cut in the side of the support to permit adequate passage of the liquid from the chamber 14 when it is desired to replenish the liquid on the brush.

The piston chamber 14 is formed with a second annular constriction 21 which functions as the valve seat when a spherical ball 22 falls against it as the container is inverted. A third annular constriction 23 at the lower or reservoir end of the piston chamber retains the ball 22 within the chamber when the container is in its upright position as shown in FIG. 1.

Figure 1:
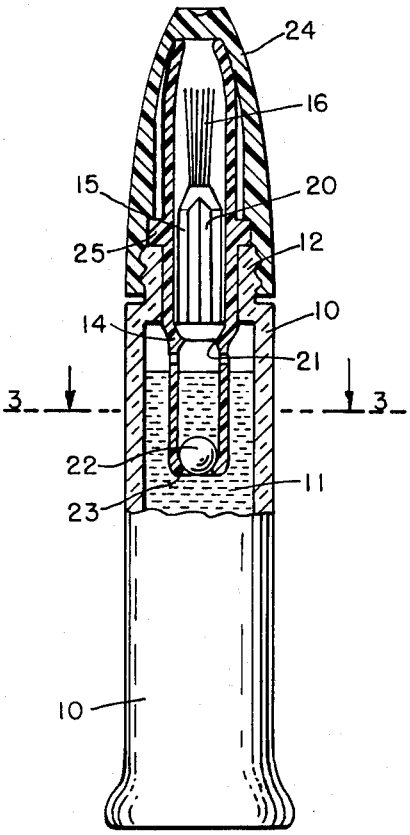
FIG. 1 is a side view of the fountain brush, partly in section, showing the container in its upright position, with the brush withdrawn and a cylindrical cap closing the brush opening.

As shown in FIG. 1, a cylindrical cap 24 is employed to act as a closure unit eliminating evaporation, sealing the top edge of the piston chamber 14 and clamping a flange 25 against the top edge of the glass container 10. The upper portion of the reservoir end of the piston chamber 14 is formed with two holes 26 which act as air escapement valves and increase the pumping action of the ball 22. The holes 26 permit the brush support 15 to move down into the piston chamber and displace liquid when the container is moved to its upright position (see FIG. 1). The holes 26 also allow fluid to enter the lower portion of the brush end of the piston chamber 14 prior to the movement of the ball 22 when the container is inverted. The size of the holes 26 may be varied to suit the viscosity of the liquid used.

The operation of the fountain brush is as follows: Before taking off the cap, the container is turned upside down briefly to be sure the liquid wets the brush. The cap 24 is next unscrewed from the neck 12 and the fountain brush is inverted as shown in FIG. 2. The brush 16 and its support 15 move along chamber 14 until the brush 16 extends from the brush end of chamber 14 and cone 17 forms a seal with the lower end of the piston chamber. Since the brush has been wetted with the liquid in the reservoir 10, the brushing action may begin at once. When the liquid held by the brush is used up, an additional supply is obtained from the inside of the piston chamber by pressing the end of the brush on a substrate and the cone surface 17 is moved away from the first constriction. When the liquid in the upper portion of the piston chamber 14 is exhausted, the container is returned to its upright position, the ball 22 moves to the position shown in FIG. 1 and more liquid is collected in the chamber 14. A second inversion moves liquid to the brush as the brush 16 is extended for more brushing action.

From the above description of the device and its operation, it is obvious that the fountain brush can be held with one hand for an entire painting operation. There is no need for repeated dipping of a brush into a container. The cone valve gives the operator control of the liquid supplied to the brush and by inverting the container, the ball valve controls the liquid supplied to the piston chamber.

After a painting sequence, the container is turned right side up, the brush falls into the piston chamber and the cap 24 can be screwed into place, sealing the contents against evaporation. After the first use, there will always be some liquid retained in the liquid chamber, held by the ball as shown in FIG. 1. For this reason the device can generally be used as soon as the cap is removed and the brush extended.

Having thus fully described the invention, what is claimed as new and desired to be secured by Letters Patent of the United States is:

1. A fountain brush comprising a container defining a reservoir for the storage of liquid; a piston chamber having a brush end and a reservoir end and disposed at the upper end of and communicating with said container and having at its brush end a first valve defining first annular restricted opening; a second valve defining second annular constriction formed in said piston chamber between the ends thereof; a valve member vertically independently movable in said chamber between said second valve and the reservoir end of said chamber so that said valve member moves between a second valve engaging and closing position and a valve opening position spaced from said valve in response to the inverted and upright position of said fountain brush respectively and a brush member disposed within said piston chamber and having a length no greater than the distance between said first and second valves and including a brush support piston section proximate said second valve and an outer brush section proximate said first valve, said brush member being longitudinally movable between a retracted position with said brush member being fully housed within said chamber and disengaged from said first valve and an advanced position with said brush section projecting outwardly through said chamber brush end and the end of said piston proximate said brush section engaging said first valve, means to permit said valve member to move between its second valve open and closed positions independently of the position of said brush member.

2. A fountain brush as claimed in claim 1 wherein the piston chamber is made of deformable material such as polyethylene.

3. A fountain brush as claimed in claim 1 wherein the container is formed with a threaded neck for the attachment of a closure cap.

4. A fountain brush as claimed in claim 1 wherein said means comprises at least one hole in the chamber wall below and adjacent to the second annular construction for pumping liquid in communication between the reservoir and the chamber.

5. A fountain brush as claimed in claim 1 wherein said container is generally cylindrical.

6. The fountain brush of claim 1 wherein said valve member comprises a ball.

7. A fountain brush as claimed in claim 6 wherein said piston chamber is formed with a third annular constriction at the reservoir end of the chamber for retaining the ball within the piston chamber when the container is in its upright position.

* * * * *